US007127184B2

(12) United States Patent
Coriale et al.

(10) Patent No.: US 7,127,184 B2
(45) Date of Patent: Oct. 24, 2006

(54) METHOD AND DEVICE FOR CLEARING MEDIA JAMS FROM AN IMAGE FORMING DEVICE

(75) Inventors: Matthew Christopher Coriale, Lexington, KY (US); Delbert Lester Elliott, Georgetown, KY (US); Michael David Maul, Lexington, KY (US); Jason Rowe, Richmond, KY (US); David Anthony Schneider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/729,210

(22) Filed: Dec. 5, 2003

(65) Prior Publication Data

US 2005/0123309 A1 Jun. 9, 2005

(51) Int. Cl.
*B31F 1/07* (2006.01)
*B41F 1/00* (2006.01)

(52) U.S. Cl. ..... 399/21; 399/18; 399/33; 399/322

(58) Field of Classification Search ..... 399/21, 399/18, 33, 322
See application file for complete search history.

(56) References Cited

U.S. PATENT DOCUMENTS 4,176,941 A * 12/1979 Breitenkam et al. ..... 399/24
4,320,953 A 3/1982 Schultes et al.
4,360,279 A 11/1982 Sugiura
4,411,511 A 10/1983 Ariyama et al.
4,566,684 A 1/1986 Gysling
4,577,849 A 3/1986 Watanabe
4,580,917 A 4/1986 Hibino
4,589,765 A 5/1986 Perun et al.
4,627,711 A 12/1986 Schron
4,660,821 A 4/1987 Boser et al.
4,682,158 A 7/1987 Ito et al.
4,682,769 A 7/1987 Murakami et al.
4,744,687 A 5/1988 Nukaya et al.
4,766,463 A 8/1988 Watanuki et al.
4,790,524 A 12/1988 Murakami et al.
4,809,969 A 3/1989 Bastow et al.
4,868,609 A 9/1989 Nagata et al.
4,884,796 A 12/1989 Daboub
4,900,003 A 2/1990 Hashimoto
4,908,655 A 3/1990 Takagi
4,919,318 A 4/1990 Wong
4,990,011 A 2/1991 Underwood et al.
4,996,557 A 2/1991 Takagi
5,034,780 A 7/1991 Kotabe et al.
5,056,771 A 10/1991 Beck et al.
5,081,508 A * 1/1992 Kotani et al. ..... 399/21

(Continued)

FOREIGN PATENT DOCUMENTS

JP 11334181 A * 12/1999

*Primary Examiner*—Andrew H. Hirshfeld
*Assistant Examiner*—Marvin P. Crenshaw
(74) *Attorney, Agent, or Firm*—Coats & Bennett, PLLC

(57) ABSTRACT

A method and device for removing media sheet jams within an image forming device. The position of the media sheets is monitored as the media sheets move through the image forming process. The occurrence of a media jam is detected, and the position of each media sheet within the device at the time of the jam is also detected. A message is displayed to an operator indicating the number of sheets within the device that should be removed to clear the jam. The order of media sheet removal may also be displayed to the operator.

13 Claims, 4 Drawing Sheets

U.S. PATENT DOCUMENTS 5,121,914 A 6/1992 Hargreaves
5,121,915 A 6/1992 Duncan et al.
5,141,217 A 8/1992 Lim et al.
5,164,770 A 11/1992 Furuichi et al.
5,171,977 A 12/1992 Morrison
5,182,597 A 1/1993 Masuda et al.
5,197,726 A 3/1993 Nogami
5,253,862 A 10/1993 Acquaviva et al.
5,277,415 A 1/1994 Kinoshita et al.
5,280,322 A 1/1994 Kono
5,393,044 A 2/1995 Hagihara et al.
5,414,495 A 5/1995 DeVito et al.
5,423,527 A 6/1995 Tranquilla
5,465,955 A 11/1995 Krupica et al.
5,495,326 A 2/1996 Mikida
5,499,091 A * 3/1996 Kasiwabara et al. ..... 399/364
5,501,444 A 3/1996 Yukimachi et al.
5,507,478 A 4/1996 Nottingham et al.
5,580,046 A 12/1996 Beaufort et al.
5,601,283 A 2/1997 Pinckney
5,602,625 A 2/1997 Okamoto et al.
5,651,538 A 7/1997 Chung et al.
5,667,215 A 9/1997 Yoshino
5,692,741 A 12/1997 Nakamura et al.
5,790,916 A * 8/1998 Sawada ..... 399/21
5,815,766 A * 9/1998 Miller et al. ..... 399/21
5,826,135 A 10/1998 Lee
5,878,302 A * 3/1999 Inui et al. ..... 399/81
5,878,321 A 3/1999 Miyazaki et al.
5,893,657 A * 4/1999 Matsuzawa ..... 399/18
5,937,245 A * 8/1999 Inoue et al. ..... 399/175
5,970,274 A 10/1999 Rath
5,970,277 A 10/1999 Shigeta et al.
6,011,936 A 1/2000 Kaneko
6,076,821 A 6/2000 Embry et al.
RE37,007 E 1/2001 Gerlier
6,170,816 B1 1/2001 Gillmann et al.
6,173,952 B1 1/2001 Richards et al.
6,205,297 B1 * 3/2001 Tachibana et al. ..... 399/21
6,273,418 B1 8/2001 Fujikura et al.
6,330,424 B1 12/2001 Chapman et al.
6,375,180 B1 4/2002 Kawano et al.
6,381,422 B1 4/2002 Tanaka
6,382,618 B1 5/2002 Takada
6,385,406 B1 5/2002 Funamizu et al.
6,446,954 B1 9/2002 Lim et al.
6,519,443 B1 2/2003 Coriale et al.
6,533,268 B1 3/2003 Williams et al.
6,560,415 B1 * 5/2003 Hirako et al. ..... 399/18
6,575,458 B1 6/2003 Williams et al.
6,578,844 B1 6/2003 Acquaviva et al.
6,658,218 B1 * 12/2003 Krolczyk et al. ..... 399/16
6,898,382 B1 * 5/2005 Shibaki ..... 399/16
2002/0009302 A1 1/2002 Kodama et al.

* cited by examiner

METHOD AND DEVICE FOR CLEARING MEDIA JAMS FROM AN IMAGE FORMING DEVICE

BACKGROUND

Image forming devices move a media sheet through an extended media path. The media sheet undergoes numerous image forming operations along the path that may include initial input into the media path from an input tray or exterior input, receiving toner or ink that forms the image, fusing of the toner or ink onto the media sheet, and duplexing for image formation on a second side. Numerous media sheets may be moving along the media path simultaneously as the device processes a multi-page print request, and/or prints numerous print requests at the same time.

One or more of the media sheets may become jammed along the media path during the image formation. The image forming device is configured to stop operating upon the occurrence of a jam. The operator is required to determine where the jam occurred, and to remove the one or more media sheets located along the media path. Image formation is restarted once the sheets are removed.

It is often difficult for the operator to determine the location of the media jam. Often times the operator must open the numerous access doors and search for the sheets in the media path. This process is time consuming and frustrating. Often times, the operator is unable to locate the sheets in the media path. An operator panel on the exterior of the device may indicate a jam, but is often not useful in assisting the operator to locate and clear the jam.

Another aspect adding to the difficulty is that numerous media sheets may be involved in the jam. The operator may successfully locate and remove a first sheet, only to discover that other sheets along the media path should also be removed. The frustration is further heightened when the operator is unaware of the multi-sheet jam and has closed all the clearance doors after removing the first sheet with the expectation of restarting image formation.

SUMMARY

The present invention is directed to a device and method for clearing media jams. One or more media sheets move along the media path during the image formation process. The media sheets may be from a single print job, or from a plurality of different print jobs that are being simultaneously processed. The location of the media sheets is monitored by a controller that oversees the image formation. A media jam is detected when one or more of the sheets does not reach a predetermined point along the media path by a predetermined time. At the time of the media jam, the controller determines the positions of the media sheets within the media path. The controller further determines which of the numerous access points that provide access to the media path are the most appropriate to remove the media sheets. The determination may be based on a number of factors, including how the media sheet can be removed while causing little to no damage to the device, and which of the access points provides the most ergonomic straight-forward access to the media sheets. The number of media sheets within the media path, and the access points for accessing the media sheets are displayed to assist an operator in clearing the jam and resuming image formation.

DETAILED DESCRIPTION

Figure 1:
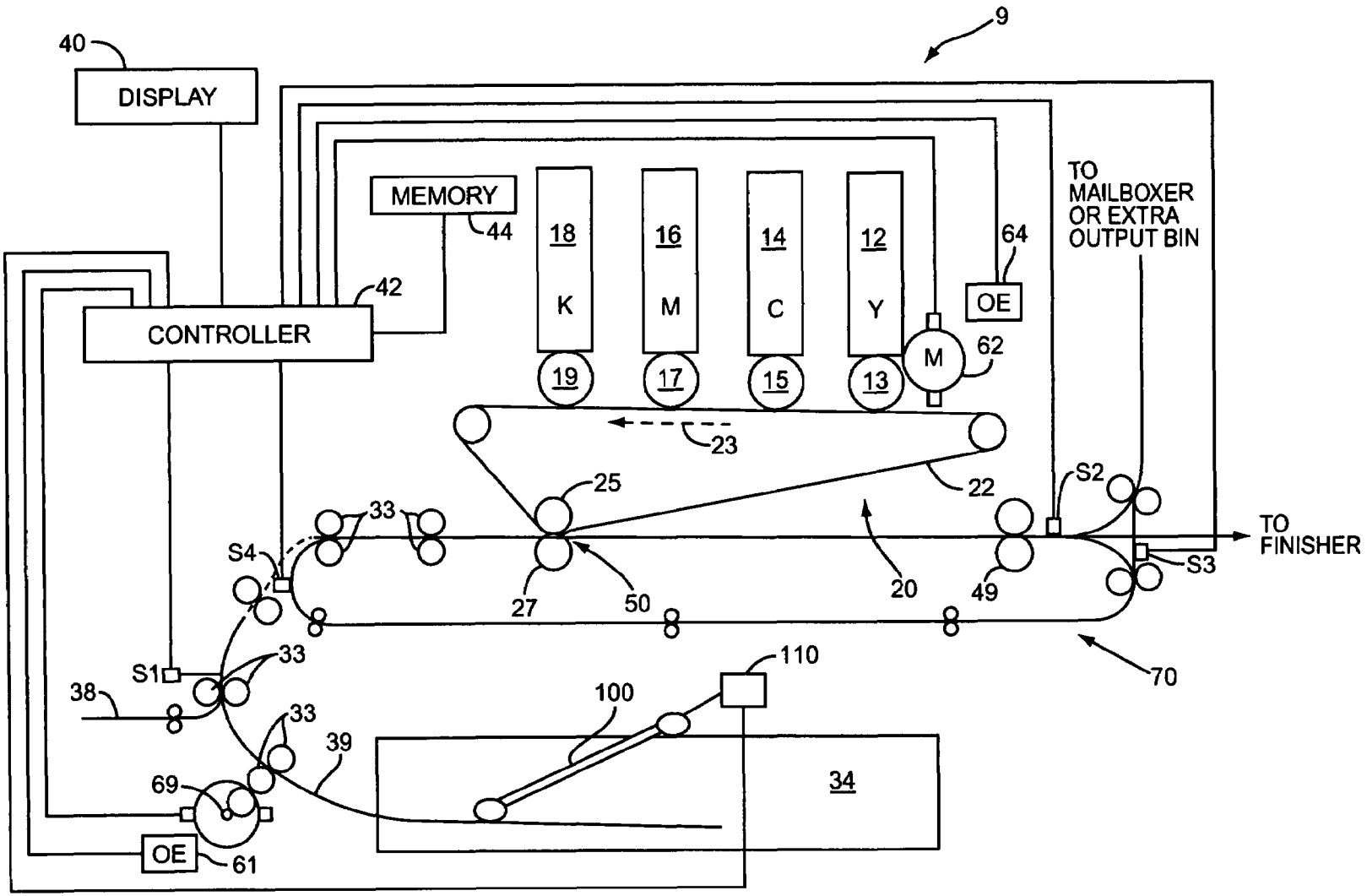
FIG. 1 is a partial schematic side view of one embodiment of an image forming device according to the present invention.

The present invention is directed to an image forming device, generally illustrated as 9 in FIG. 1, that monitors the position of media sheets moving through the image forming process. The device 9 detects the occurrence of a media jam and determines the position of each media sheet within the device at the time of the jam. A message is displayed to an operator indicating the number of sheets and the access points at which to remove the sheets from the media path. The order of media sheet removal may also be displayed to the operator.

In the embodiment of FIG. 1, a plurality of toner cartridges 12,14,16,18 each have a corresponding photoconductive drum 13, 15, 17, 19. Each toner cartridge has a similar construction but is distinguished by the toner color contained therein. In one embodiment, the device 9 includes a black cartridge 18, a magenta cartridge 16, a cyan cartridge 14, and a yellow cartridge 12. The different color toners form individual images in their respective color that are combined in layered fashion to create the final multicolored image.

Each photoconductive drum 13, 15, 17, 19 has a smooth surface for receiving an electrostatic charge from a laser assembly (not illustrated). The drums continuously and uniformly rotate past the laser assembly that directs a laser beam onto selected portions of the drum surfaces forming an electrostatic latent image representing the image to be printed. The drum is rotated as the laser beam is scanned across its length. This process continues as the entire image is formed on the drum surface.

After receiving the latent image, the drums rotate past a toner area having a toner bin for housing the toner and a developer roller for uniformly transferring toner to the drum. The toner is a fine powder usually composed of plastic granules that are attracted to the electrostatic latent image formed on the drum surface by the laser assembly.

An intermediate transfer medium (ITM) belt 22 receives the toner images from each drum surface. As illustrated in FIG. 1, the ITM belt 22 is endless and extends around a series of rollers adjacent to the drums 13, 15, 17, 19 as it moves in the direction indicated by arrow 23. The ITM belt 22 and drums 13, 15, 17, 19 are synchronized providing for the toner image from each drum to precisely align in an overlapping arrangement. In one embodiment, a multi-color toner image is formed during a single pass of the ITM belt 22. By way of example as viewed in FIG. 1, the yellow (Y) toner is placed first on the ITM belt 22, followed by cyan (C), magenta (M), and black (K). In one embodiment, ITM belt 22 makes a plurality of passes by the drums to form the overlapping toner image.

ITM belt 22 moves the toner image towards a second transfer point 50 where the toner images are transferred to a media sheet. A pair of rollers 25, 27 form a nip where the toner images are transferred from the ITM belt 22 to the media sheet. The media sheet with toner image then travels through a fuser 49 where the toner is adhered to the media sheet. The media sheet with fused image is then either output to a finisher, exits from the image forming device 9, or is routed through a duplexer 70 for image formation on a second side.

Media path 39 is formed by a series of nip rollers 33 spaced a distance apart. The media path 39 extends between the input trays 34, the second transfer 50, fuser 49, duplexer 70, and finisher or exit. The nip rollers 33 are rotated by a motor 69 to control the speed and position of each media sheet as it moves along the media path 39. Motor 69 in turn is controlled by a controller 42 that oversees the image forming process. FIG. 1 illustrates one embodiment having a single motor 69 that controls the nip rollers 33 along the media path 39. Various numbers of motors 69 may be positioned along the media path 39 to control the media sheets.

Controller 42 oversees the timing of the toner images and the media sheets, and the overall image forming process. In one embodiment as illustrated in FIG. 1, controller 42 includes a microprocessor with associated memory 44. In one embodiment, controller 42 includes a microprocessor, random access memory, read only memory, and an input/output interface. A display 40 may further be operatively connected to the controller 42 for displaying messages to an operator. The display 40 may include an LED or LCD array to display alpha-numeric characters.

Media sheets are introduced into the media path 39 in a variety of different manners. In one method, an input tray 34 holds a stack of media sheets, and a pick mechanism 100 picks a topmost sheet from the stack and feeds it towards the media path 39. A drive assembly 110 controlled by controller 42 activates the pick mechanism 100 and moves the media sheet into the media path 39. The embodiment illustrated in FIG. 1 includes a single input tray 34. Multiple input trays having various media capacity and being able to hold various media sizes may also be included to introduce media sheets. A multi-purpose feeder 38 provides another method of introducing media sheets into the media path 39. Media sheets are manually loaded by an operator into the multi-purpose feeder 38 and rollers 33 move the sheet along the media path 39.

One or more sensors S1, S2, S3, S4, referred to collectively as sensors, are placed along the media path 39 to determine the position of the media sheet. In one embodiment, sensors are optical sensors that detect a leading edge or trailing edge of the media sheet when passing the sensor location. The sensors include an emitter that transmits a signal and a receiver that receives the signal. The signal is interrupted when the media sheet passes past the sensor thus indicating the location. One embodiment of a sensor includes a light-emitting diode as the emitter and a phototransistor as the receiver. In another embodiment, sensors include an actuator arm positioned within the media path 39. Movement of the media sheet along the media path 39 causes the actuator arm to be pushed aside which either actuates a switch, or is sensed by an emitter/receiver combination as described above. In one embodiment, a first sensor S1 is placed on the media path upstream from the input tray 34, a second sensor S2 downstream from the fuser 49, a third sensor S3 at the input of the duplexer 70, and a fourth sensor S4 at the exit of the duplexer 70. Additional sensors may be placed at the input trays 34. Each sensor is operatively connected to the controller 42 and provides the controller with an accurate location of the media sheets.

Encoder 61 is operatively connected to the controller 42 and ascertains the revolutions and rotational position of the motor 69. Each revolution of the motor 69 equates to a predetermined amount of movement of the media sheet along the media path 39. Tracking the revolutions of the motor 69 provides for the controller 42 to track the movement and location of each media sheet along the media path 39 when the media sheets are not located at a sensor.

The position of the media sheets along the media path 39 is tracked by the sensors positioned throughout the media path 39, the speed of the motor 69, and the feedback from the encoder 61. The controller 42 registers the position at the time a media sheet passes through a sensor. Subsequent positions are calculated by monitoring the feedback from the encoder 61 to determine the distance the sheet has moved since being detected by the sensor. By way of example, at some designated time, pick mechanism 100 receives a command from the controller 42 to pick a media sheet. The media sheet moves through the beginning of the media path 39 and eventually trips a media path sensor S1. Controller 42 begins tracking incrementally the position of the media sheet by monitoring the feedback of encoder 61 associated with the motor 69. The position of the media sheet is tracked in this manner until the media sheet moves through another sensor. In the embodiment of FIG. 1, this occurs when the media sheet moves through the fuser 49 and is detected by sensor S2. The incremental distance of the media sheet is again tracked by monitoring the feedback of the encoder 61 until the next sensor detects the media sheet. In the embodiment of FIG. 1, this occurs at the entrance of the duplexer 70 by sensor S3. The position of the media sheet continues to be tracked in this manner with the location detected by the sensors, and incremental positions tracked by monitoring the motors 69 and encoders 61. In another embodiment, the incremental location is determined by monitoring the number of steps taken by the motor 69 since the media sheet has last moved through a sensor.

One embodiment of the movement of the media sheets along the media path 39, and the monitoring of the location of the media sheets is disclosed in U.S. Pat. No. 6,330,424, assigned to Lexmark International, Inc., and herein incorporated by reference in its entirety.

Controller 42 includes requirements for the sheets to move between points along the media path 39. Controller 42 determines that a jam has occurred when the media sheet does not pass through the downstream point within the predetermined number of encoder pulses. By way of example using the embodiment of FIG. 1, controller 42 includes a predetermined number of encoder pulses required for the media sheet to move between sensor S1 and sensor S2. The pulses are counted starting when the media sheet passes through sensor S1 and the controller 42 determines a jam has occurred if the media sheet has not passed through sensor S2 within the predetermined number of pulses. In another embodiment, controller 42 stores a time period for the media sheet to move between two points based on the motor speed. A jam is determined if the media sheet does not reach the second point within the predetermined time period. The distance monitored by the controller 42 may be between adjacent sensors (e.g., S1 and S2), or between any two sensors on the media path 39 (e.g., S1 and S4).

At the time of a jam, controller 42 ascertains the position of the media sheet. The location may be determined as a function of the number of encoder pulses since passing the last sensor, or the time and motor speed since passing the last sensor. Another method of determining the jam location is for the controller 42 to be equipped with statistical information indicating the most likely location of a media jam for each predetermined distance. The statistical information is ascertained from diagnostic testing which indicates the most statistically-likely location of the jam. By way of example and using the embodiment of FIG. 1, the second transfer 50 may be the most statistically-likely location of a jam between sensors S1 and S2. Likewise, the intersection between the simplex and duplex paths may be the most statistically-likely location between sensors S2 and S3. Determining the position of the jam allows for the controller 42 to send instructions to the display 40 to assist the operator in correcting the problem.

Controller 42 further includes a listing of the access points stored within memory 44. Access points are positions on the device 9 where the user can access a media sheet on the media path 39. Access points may include doors, input drawers, or observable points along the media path where the user can access a media sheet. One or more access points are stored for each location along the media path 39. At the occurrence of a jam, controller determines the position of each media sheet and displays the corresponding access point for accessing and removing the media sheet. When more than one access point is available for the location, the access points are prioritized according to the least disruptive to the device 9, and the most ergonomically straight-forward. The controller 42 displays the access points in the prioritized order and the operator is to attempt access of the media sheet in that order. If the operator is unable to access the media sheet through the first access point, the second access point may then be used.

Figure 2:
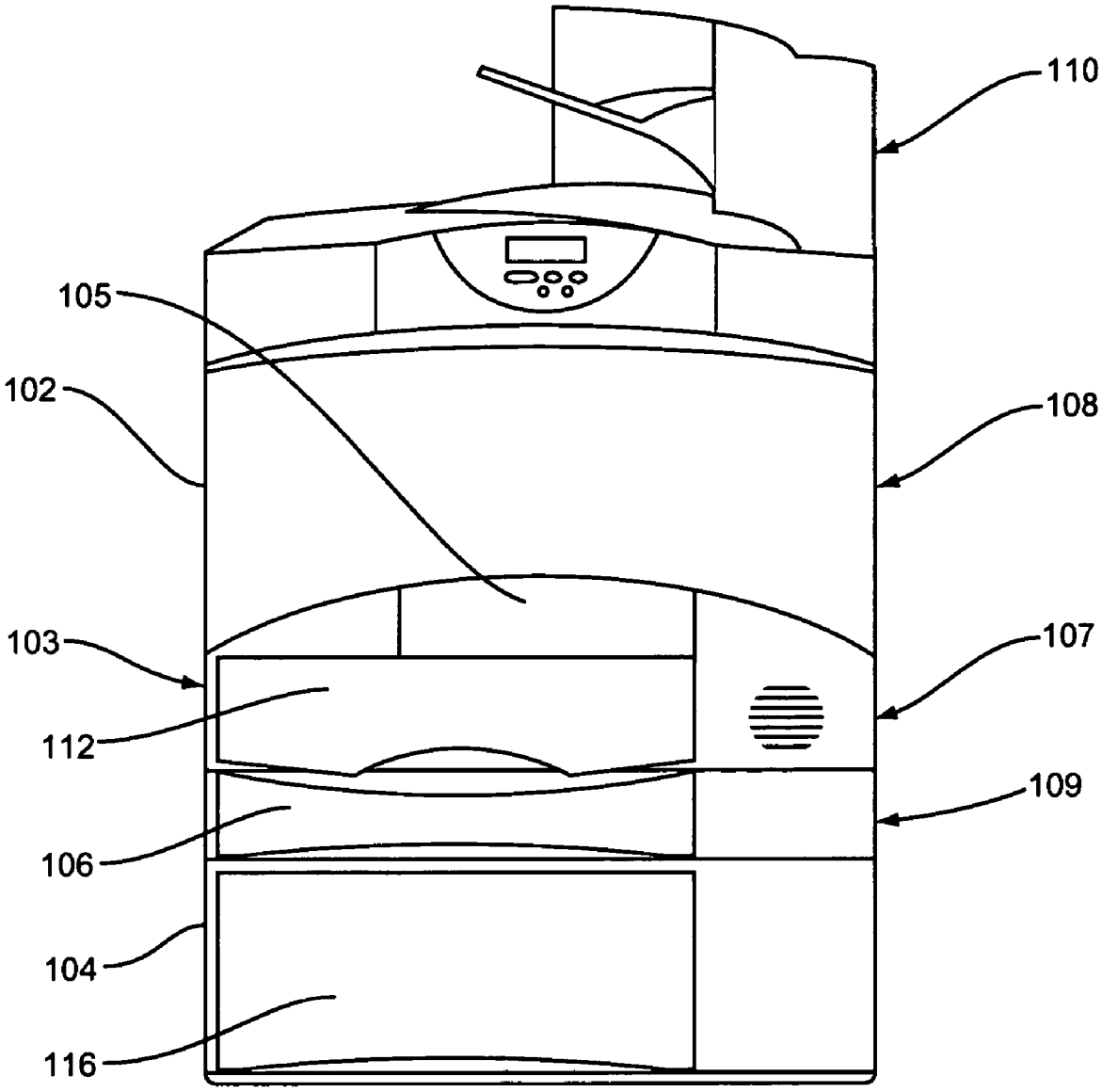
FIG. 2 is a side view of some of the access points on the exterior of the image forming device according to one embodiment of the present invention.

FIG. 2 illustrates one embodiment of the exterior of the image forming device 9 and various doors and drawers. Access points include a multipurpose feeder door 102, left access door 103; front access door 105; output expander or mailboxer door 110; upper right access door 108; lower right access door 107; duplexer right access door 109; duplexer front access door 106; first media tray drawer 112; left access door 104; and second media tray drawer 116. Each of the doors and drawers provide access to different sections of the media path 39.

Least disruptive is defined as the manner of removing the media sheet that will be the least likely to cause damage to the device or require the least amount of maintenance or operator intervention to correct. By way of example, if a jam is detected between the second transfer 50 and the fuser 49, a media sheet may contain unfused toner. Controller 42 prompts the user to remove the media sheet through the front access door 105 where the media sheet is pulled perpendicularly away from the media path 39. The controller 42 does not indicate to access the jammed media through a side door such as the lower right access door 107 or left access door 103 because the media sheet may be pulled through the rollers 25, 27 or fuser rollers 49 which would smear the unfused toner onto the rollers thus requiring maintenance to clean the rollers prior to the next print job.

In another embodiment when a media sheet is jammed while exiting a media drawer, the least disruptive access is through a side door. Accessing the jam by opening the media drawer could result in the pick mechanism being damaged. This is particularly the case when the media sheet is a transparency that has a higher tear strength than a sheet of paper. Least disruptive also includes removing the media sheet in a manner least likely to tear the media and leave torn sections in the media path. Using the example of a jam at the media drawer, pulling open the media drawer could tear the media sheet leaving a remainder part within the media path at a position that may require disassembly of the device 9 to fully remove the parts. Accessing the media sheet from a side door provides the sheet to be removed without tearing.

An ergonomically correct solution is that which provides the most straight-forward access to the media sheet by the operator. The corresponding access point does not require the operator to reach into physically-difficult positions. An example of the ergonomically correct solution for jam removal may occur when a media sheet is jammed at the end of the duplexer 70. Controller 42 may indicate to remove the sheet through duplexer front access door 106 which provides more straight-forward access to the jam then through duplexer right access door 109, or left access door 103. Another example of an ergonomic solution occurs when a media sheet has just been introduced into the finisher. The ergonomic solution is to separate the finisher from the main body of the device 9. An ergonomic solution also accounts for preventing the media sheet from tearing during removal because a remainder of a sheet within the media path 39 may be very difficult to access.

Controller 42 may indicate a single access point to remove the media sheet, or may indicate a plurality of access points. When indicating a plurality of access points, controller 42 will list first the access point that is least disruptive and ergonomically correct manner, and then list other alternatives if removal is unsuccessful. In one embodiment, the prioritization for removing media sheets from the device 9 includes removing the media sheets through the following access points:

Priority 1: multipurpose feeder door 102, left access door 103, left access door 104

Priority 2: front access door 105, duplexer front access door 106, input drawers 112, 116

Priority 3: duplexer right access door 109, lower right access door 107, upper right access door 108, output expander or mailboxer door 110

Priority 4: finisher

Controller 42 may further prioritize observable points along the media path 39 in addition with the doors and drawers. By way of example, the priority may include accessing a particular door, but then removing the media sheet at a particular point on the media path. This is particularly useful when a single door or drawer provides multiple means of access to the media path 39.

Multiple media sheets may be present throughout the media path 39 at one time, and may be part of a multi-page print job, or multiple print jobs. The controller 42 monitors the position of each sheet in the same manner as described above. At the occurrence of a jam, controller 42 determines the position of each media sheet along the media path and displays the number of media sheets that should be removed to correct the problem. The controller 42 may indicate that all media sheets within the media path 39 should be removed, or a number less than all the media sheets are to be removed. By way of example, media sheets within the finisher may not have to be removed to clear the jam, but media sheets within the duplexer path 70 may need to be removed. Indicating the number of media sheets to be removed allows the operator to know when he or she has removed all problematic media sheets and printing can resume. Some previous devices do not indicate the number of sheets and the operator either continues looking for non-existent jammed sheets, or closes the door or drawers to reset the device only to later determine that additional sheets are jammed within the media path 39.

Figure 3A:
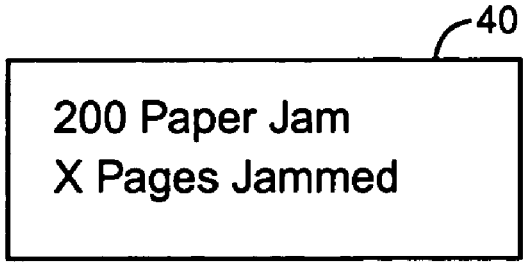
FIG. 3A is a schematic illustration of a first media jam message that is displayed to an operator according to one embodiment of the present invention.
Figure 3B:
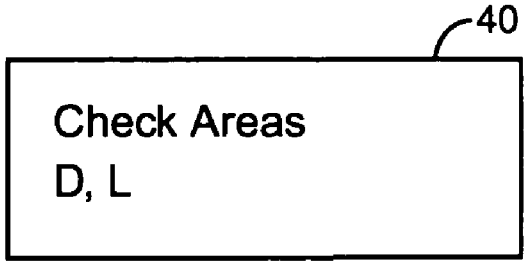
FIG. 3B is a schematic illustration of a second media jam message that is displayed to an operator according to one embodiment of the present invention.
Figure 3C:
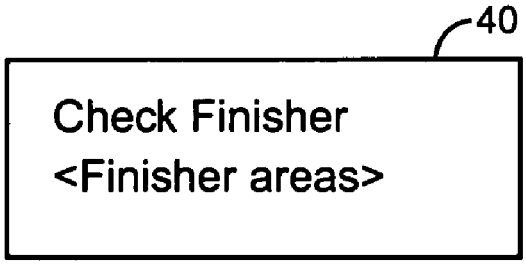
FIG. 3C is a schematic illustration of a third media jam message that is displayed to an operator according to one embodiment of the present invention.
Figure 3D:
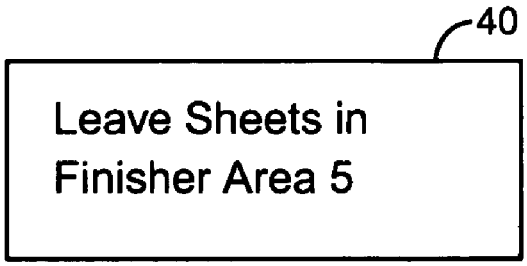
FIG. 3D is a schematic illustration of a fourth media jam message that is displayed to an operator according to one embodiment of the present invention.

In one embodiment as illustrated in FIG. 3A, a first message indicated on the display 40 is the location of the media jam. The location may be written (e.g., duplexer) or may be coded in a manner that can be referenced in a user's guide (e.g., 200). The message may further include the number of problematic media sheets that are to be removed from the media path 39. A second message as illustrated in FIG. 3B may include the access points where media sheets can be located along the media path 39. The message may further include the recommended order of the access points. In the embodiment of FIG. 3B, the media sheets are to be removed from area D prior to attempting removal through access L. A third message as illustrated in FIG. 3C indicates additional areas that are to be checked along the media path. FIG. 3D illustrates a fourth message indicating that particular sheets are to remain within the media path 39. The display 40 may toggle between the messages, to show two or more of the messages.

Each of the access points is identified for the operator. In one embodiment, a single label is adhered to the device 9 that maps the locations of the access points. Individual labels may also be positioned on the device 9 at each of the access points. By way of example, D is the front access door; A is the multipurpose feeder; B is the left access door, etc. In one embodiment, the lettering scheme consists of one letter for each area of the device 9 and T(X) for each media drawer.

Figure 4:
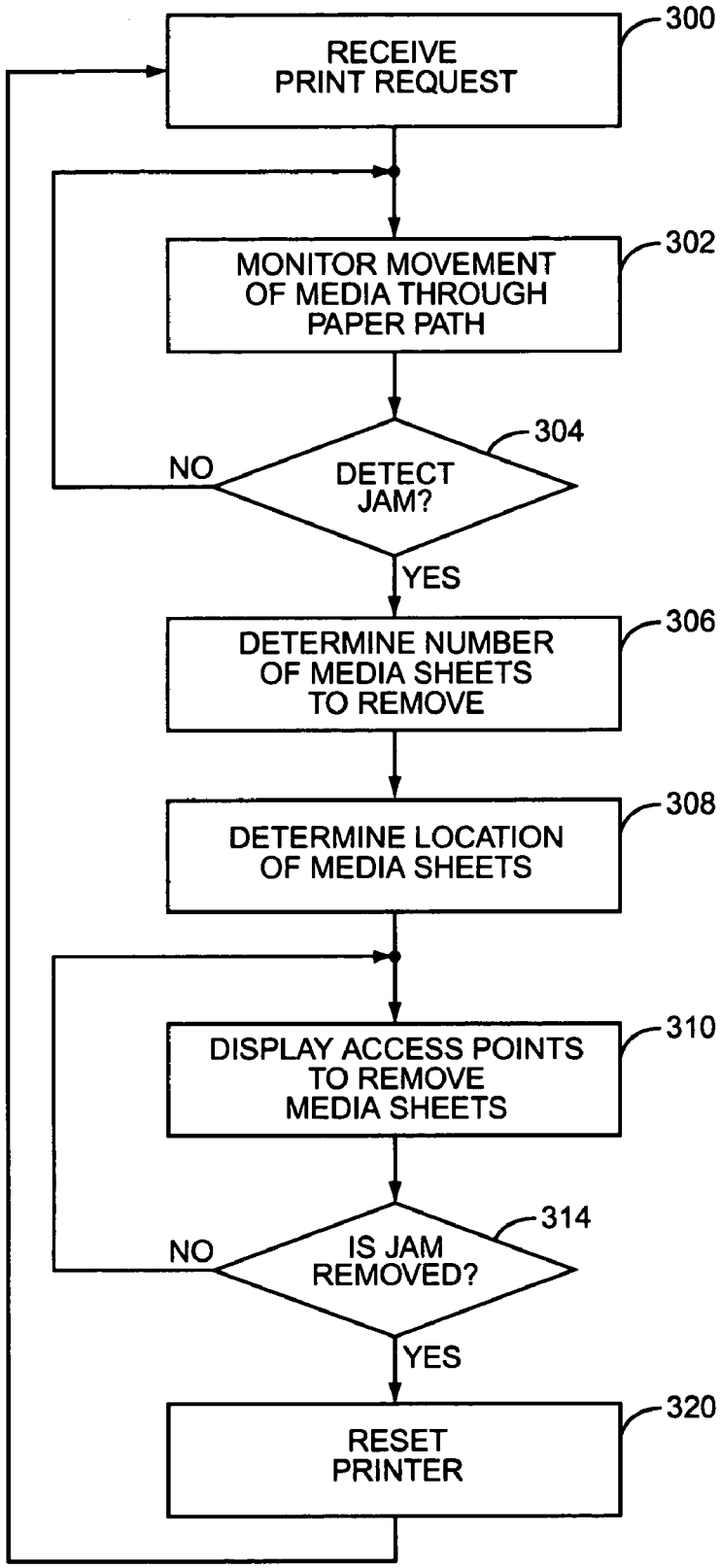
FIG. 4 is a flowchart diagram of one method of practicing the present invention.

FIG. 4 is an example of one method of using the present invention. A print request is received from an operator (step 300). One or more print requests may be processed at one time, and the controller 42 monitors the movement of the media sheets through the media path 39 (step 302) and detects a jam (step 304). The controller 42 determines the number of media sheets along the media path 39 that are to be removed as a result of the jam (step 306) and the positions of the media sheets that are to be removed (step 308). Controller 42 shows on the display 40 the number of media sheets that are to be removed from the media path 39 and the access points to access and remove each of the media sheets (step 310).

After the operator removes one or more of the sheets and closes the doors and drawers, controller 42 determines whether the media sheets have been successfully removed (step 314). If the jam is removed, the image forming device 9 is reset and another print job may be received (step 320). If the media sheets are not successfully removed, a message is displayed on the display 40 notifying the operator. The additional message may provide further jam-clearing information, or may simply indicate that the jam is still present.

In one embodiment, if the operator inputs a print request after an unsuccessful jam removal, a secondary jam removal message will be displayed. The controller 42 does not display the number of remaining sheets within the media path 39 because there is no manner of determining how many sheets were previously successfully removed by the operator. Likewise, after a jam is cleared and the operator inputs another print request but a jam is declared prior to the picked media sheet reaching the exit bin, the controller 42 will also be unable to display the number of sheets in the media path 39.

FIG. 1 illustrates one embodiment of the image forming device 9. The embodiment of FIG. 1 is a color laser printer, however, the present invention is also applicable to other types of image forming devices that move media sheets during the image formation process. The present invention may be carried out in other specific ways than those herein set forth without departing from the scope and essential characteristics of the invention. In one embodiment, the priority of the access points is ascertained during testing of the device 9. The embodiment illustrated in FIG. 1 comprises separate cartridges for each different color. The present invention is not limited to this embodiment, and may also be applicable to image forming device featuring a single cartridge. The present embodiments are, therefore, to be considered in all respects as illustrative and not restrictive, and all changes coming within the meaning and equivalency range of the appended claims are intended to be embraced therein.

What is claimed is:

1. A method of clearing a jam from an image forming device, the method comprising the steps of:

tracking the position of a media sheet moving through a media path;

detecting a media jam when the media sheet does not reach a predetermined point on the media path within a predetermined limit;

immediately stopping the movement of the media sheet upon detecting the media jam;

determining the position of the media sheet at the time of the media jam based on media jam statistical information stored within a controller;

determining which one of a plurality of access points provides access to the media jam in a least damaging and ergonomically correct manner; and displaying the one of the plurality of access points to an operator.

2. The method of claim 1, wherein the step of determining the position of the media sheet at the time of the media jam comprises detecting an amount of time since the media sheet has moved beyond a sensor and the speed of the media sheet moving along the media path.

3. The method of claim 1, further comprising displaying a second access point selected from the plurality of access points to access the media sheet when the operator is unable to reach the media sheet through the one of the plurality of access points.

4. The method of claim 1, further comprising displaying the location of the media jam to the operator.

5. The method of claim 1, wherein the step of determining the position of the media sheet at the time of the media jam comprises monitoring feedback from an encoder since the media sheet has moved beyond a sensor.

6. The method of claim 1, wherein the step of determining the position of the media sheet at the time of the media jam comprises using the number of steps taken by a motor.

7. A method of clearing a media jam from an image forming device comprising the steps of:

detecting a media jam within a media path;

immediately stopping movement of a number of media sheets within the media path upon detecting the media jam;

determining the number of media sheets within the media path;

determining a location of each of the media sheets along the media path based on statistical information stored within a controller;

displaying the number of media sheets within the media path;

determining which of a plurality of access points are to access and remove each of the media sheets; and displaying the plurality of access points that are to be opened in an order of priority to remove the media sheets and cause a least amount of damage to the device.

8. The method of claim 7, wherein the access points displayed are less than a total number of access points on the image forming device.

9. The method of claim 7, wherein the step of determining which of the plurality of access points are to be opened comprises determining ergonomic requirements for accessing the media sheets through each of the plurality of access points.

10. The method of claim 7, further comprising instructing an operator to keep at least one of the plurality of media sheets within the media path.

11. A method of clearing a jam from an image forming device comprising the steps of:

dividing a media path into sections each comprising a length of the media path;

storing within a controller an access point that provides access to each of the sections;

storing within the controller statistical information indicating likely locations for media jams;

monitoring movement of media sheets along the media path;

detecting a jam along the media path and the section of each of the media sheets at the time of the jam;

determining where along the section each of the media sheets is positioned at the time of the jam based on the statistical information;

determining the access point that correlates to each of the sections where the media sheets are located; and displaying the access points.

12. The method of claim 11, further comprising storing two or more access points within the controller that give access to each of the sections of the media path.

13. The method of claim 11, further comprising displaying a total number of the media sheets within the media path at the time of the jam.

* * * * *